US007478812B2

(12) United States Patent
Sokolov

(10) Patent No.: US 7,478,812 B2
(45) Date of Patent: Jan. 20, 2009

(54) GAME SYSTEM

(75) Inventor: Gary Sokolov, Caulfield North (AU)

(73) Assignee: Mayontek Corporation Pty Ltd. (AU)

( * ) Notice: Subject to any disclaimer, the term of this patent is extended or adjusted under 35 U.S.C. 154(b) by 110 days.

(21) Appl. No.: 10/511,027

(22) PCT Filed: Apr. 4, 2003

(86) PCT No.: PCT/AU03/00412

§ 371 (c)(1),
(2), (4) Date: Sep. 30, 2004

(87) PCT Pub. No.: WO03/086559

PCT Pub. Date: Oct. 23, 2003

(65) Prior Publication Data

US 2005/0167912 A1 Aug. 4, 2005

(30) Foreign Application Priority Data

Apr. 5, 2002 (AU) ..... PS1572
Jun. 3, 2002 (AU) ..... PS2759

(51) Int. Cl.
*A63B 71/00* (2006.01)

(52) U.S. Cl. ..... 273/142 R

(58) Field of Classification Search ..... 273/142 R
See application file for complete search history.

(56) References Cited

U.S. PATENT DOCUMENTS

D31,502 S * 9/1899 Northorpe ..... D21/385
1,685,142 A * 9/1928 Smith ..... 273/282.1
2,036,718 A * 4/1936 Potter ..... 273/142 R
D163,281 S * 5/1951 Haupenthal ..... D21/375
4,149,728 A * 4/1979 Thompson ..... 273/274
4,492,378 A 1/1985 Williams
5,100,140 A * 3/1992 Foy ..... 273/142 R
5,131,663 A * 7/1992 Klein ..... 273/256
5,743,798 A 4/1998 Adams
5,775,993 A 7/1998 Fentz
6,047,965 A * 4/2000 Mollo et al. ..... 273/142 E
6,059,659 A * 5/2000 Busch et al. ..... 463/17
6,123,333 A 9/2000 McGinnis, Sr.
6,176,489 B1 * 1/2001 Astaneha ..... 273/274
6,299,533 B1 * 10/2001 Parra et al. ..... 463/17
6,302,395 B1 * 10/2001 Astaneha ..... 273/274
6,446,965 B1 * 9/2002 Boulton ..... 273/142 R (Continued)

FOREIGN PATENT DOCUMENTS

AU 713046 7/1997

(Continued)

*Primary Examiner*—Gene Kim
*Assistant Examiner*—Dolores Collins
(74) *Attorney, Agent, or Firm*—McKee, Voorhees & Sease, P.L.C.

(57) ABSTRACT

A game apparatus with: (a) an indicia selecting means including a rotatable wheel (1) having a plurality of selectable regions (20, 21, 22 etc), each region (20, 21, 22) associated with paying card indicia (31, 32, 33 respectively); (b) a means for randomly selecting a selectable region (20, 21, 22) of the wheel (1); (c) a wagering area (40) adapted for positioning wagers concerning the indicia (31, 32, 33) associated with the region (20, 21, 22) selected a single operation of the indicia selecting means. A method for operating the game system is also described.

6 Claims, 8 Drawing Sheets

U.S. PATENT DOCUMENTS

| | | | | |
|---|---|---|---|---|
| 6,497,409 | B2 * | 12/2002 | Mathews | 273/142 E |
| 6,588,754 | B1 * | 7/2003 | Adams et al. | 273/274 |
| 6,659,462 | B1 * | 12/2003 | Scott | 273/274 |
| 6,705,944 | B2 * | 3/2004 | Luciano | 463/20 |
| 6,743,094 | B2 * | 6/2004 | Johnson | 463/17 |
| 2001/0015529 | A1 | 8/2001 | Allen | |

FOREIGN PATENT DOCUMENTS

| | | |
|---|---|---|
| GB | 2 062 326 A | 5/1981 |
| WO | WO 87/02592 | 5/1987 |

* cited by examiner

GAME SYSTEM

FIELD OF THE INVENTION

The invention relates to the field of roulette like games, particularly for use in a gambling environment, but also as a toy for use by adults and children.

BACKGROUND OF THE INVENTION

Casinos and other gambling houses have numerous gaming systems in place for use by players. The house typically includes a number of 'classic' gambling games such as roulette, poker, blackjack and craps. These types of games allow multiple players to bet on the outcome of the game at the same time.

The profitability of a game installation in a casino is subject to a number of factors. These factors include the amount of floor space required for the gaming installation and players, and the number of operators required for operation and collection of monies in the game. Other factors include the popularity of the game, the number of players that may concurrently play the game, the time it takes to operate a round of the game and the odds of the game.

A well known multiplayer gambling game is roulette. This is one of the oldest of casino games, having been exclusively played at the Monte Carlo casino for over 60 years until 1933. This game of chance uses a horizontal wheel having a number of pockets evenly spaced on the upper surface, located near the perimeter of the wheel. The wheel rotates about a vertical axis and a ball is used to randomly select a pocket. Wagers are made based on identity of the pocket the ball selects.

The wheel typically has 37 or 38 separately numbered pockets, having the numbers 1 to 36, a 0 and a 00. Each number is only used once on the wheel. This style of roulette may be referred to as American roulette. In contrast the European style of roulette may omit the 00 pocket. The pockets are alternatively coloured red or black, with exception of the 0 and 00 pockets which are coloured green. The 0 and 00 pockets are normally located at opposite sides of the axis of rotation. In combination with an appropriately designed wagering area, the arrangement permits the making of a wide range of wagers having various return ratios or odds.

The motion of the wheel and the method of release of the ball should ensure a random selection of a pocket. The ball normally rotates around the wheel near or at the wheels perimeter. The perimeter is inclined to direct the ball into the pocket region of the wheel. As the rate of rotation of the wheel decreases gravity will overcome the centripetal force keeping the ball near the perimeter, and the ball will travel down the inclined surface to be captured in a pocket.

A number of variants of roulette are known. By way of example U.S. Pat. No. 6,302,395 (Astaneha) describes a combination gambling game that includes a roulette wheel having numerical indicia, dice and cards. The players bet on the outcome of two or more of the different games.

There may also be a game that involves using a roulette like wheel having playing card indicia thereon to select cards for poker hands. The wheel is spun five times to provide a poker hand, and as such wagers are paid depending on the result of a set of five selections of cards by the wheel. Whilst such a game may be suitable for home use, it is not suited for casino use as it requires five spins, and thus significant time, to provide a wager result.

Another style of game which involves a wheel is the 'wheel of fortune' game. In these games a large vertically orientated wheel is spun about a horizontal axis. The wheel has a number of evenly spaced horizontal shafts extending from the face about its perimeter. The wheel includes a number of evenly spaced regions located between the shafts and within each region there is indicia. A region selecting and braking means typically in the form of a relatively flexible member is located in a fixed position relative to the axis of the wheel and extends over a portion of the perimeter of the wheel and is capable of contacting the shafts. Some of the regions will include the same indicia that appears on other regions.

In use the wheel is spun, and the member acts to hinder and slow the motion of wheel through contact with the evenly spaced shafts. Eventually the wheel has insufficient force to move a shaft past the member and the member then acts as a pointer to indicate the selected region and indicia therein.

Wagers are made as to the outcome of the spinning of the wheel, with the odds being determined by the casino's margin, the total number of regions on the wheel and the number of occurrences of the same indicia on the wheel. This mode of operation is different to roulette like games, as a wheel of fortune provides for differing wagers and odds by including multiple copies of selected indicia on the wheel, in contrast to roulette which uses an appropriately designed wagering area.

However, as a game can become stale it is important to provide alternative games in order to ensure further custom. Preferably the game would also include a jackpot side game, as such games are currently popular at casinos. Furthermore the game should avoid complicated systems so to entice new players to try the game. Ideally the game should use rules similar to an existing game in order to promote acceptance of the game to the public.

The game should be sufficiently profitable to the house so that it is capable of being run at a casino. Casinos may be limited by license conditions to a set number of tables of gaming games and as such it is desirable to include games having a high frequency of wager determination events per hour or a high house margin or both. Such games should also be capable of being operated with multiple concurrent players with a single dealer to increase the number of wager determination events per game.

SUMMARY OF THE INVENTION

In the first embodiment of the game there is provided a game apparatus having an indicia selecting means including a rotatable wheel having a plurality of selectable regions, each region associated with playing card indicia, and a means for randomly selecting a selectable region of the wheel; and a wagering area adapted for positioning wagers concerning the indicia associated with the region selected by a single operation of the indicia selecting means.

In a second embodiment of the invention, there is a method of effecting an economic outcome between one or more players and an operator, which method includes using a game apparatus having an indicia selecting means including a rotatable wheel having a plurality of selectable regions, each region associated with playing card indicia, and a means for randomly selecting a selectable region of the wheel; and a wagering area adapted for positioning wagers concerning the indicia associated to the region selected by a single operation of the indicia selecting means, the method including the steps of:

a) a wagering phase wherein each player providing a cash or token wager on the wagering area, the location of wager defining the win or lose conditions of that wager;

b) an operation phase after the wagering phase wherein the rotatable wheel is rotated and a ball is located on a rotating wheel, in a manner capable of randomly selecting a region of the wheel;

c) an outcome phase wherein the ball becomes located on a region of the wheel, and thereby selects that region and indicia associated thereto;

d) a result phase after the outcome phase wherein an assessment of each wager of each player is effected by comparing the selected indicia of the wheel to the win or lose conditions of the wager and effecting a payment of cash or tokens to the player in response to a result of the comparison.

In a further embodiment of the invention there is provided a wagering area adapted for use in the first or second embodiment of the invention.

In a further embodiment of the invention there is provided a jackpot game within the above game method.

In a further embodiment of the invention, there is a table adapted for use with the above game or method, the table including the earlier described wheel and a wagering area having marked zones for the placement of the wagers having different win and lose conditions.

In a further embodiment of the invention there is provided an electronic form of the game, wherein part or all of the game processes is operated by or replaced with a computer or poker machine apparatus. Players may provide wagers via an input device, which is processed by a computer, which then proceeds to provide the operation, outcome and result phases. In such a system the indicia selecting means may be replaced with an electronic simulation of a rotating wheel and means for selecting a region.

In a further embodiment of the invention, there is a casino or gambling house that includes or operates the above game, apparatus for the game or operates a computer(s) that manages or controls the game operations.

BRIEF DESCRIPTION OF THE DRAWINGS

Preferred embodiments of the invention will now be described in detail with reference to the accompanying drawings in which.

DETAILED DESCRIPTION OF THE INVENTION

Figure 1:
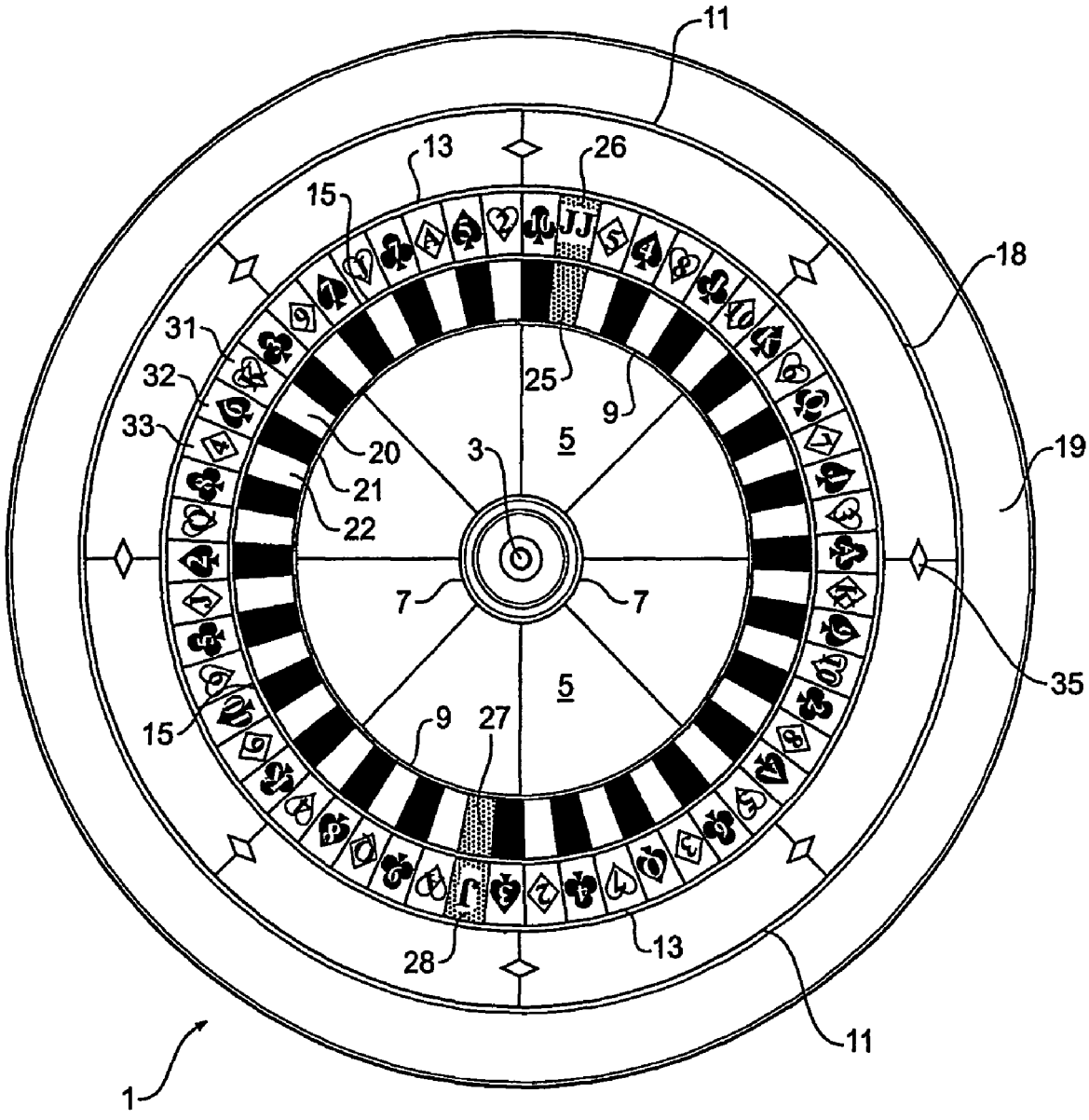
FIG. 1 depicts a plan view of a wheel for use with the game of the present invention.

The present invention is predicated on the discovery that it is possible to incorporate playing card indicia into a roulette like game and create a new type of gambling game which can use rules similar to roulette, and which is suitable for use in a casino.

Advantageously such a game can provide additional variety to known casino game systems, and can permit the inclusion of a jackpot side-game.

To avoid ambiguity a playing card is one of 54 pieces making up a pack of playing cards, and includes 13 cards of four suits—hearts, clubs, spades and diamonds (the ordinary playing cards) and two jokers. The 13 cards include ten numbered cards from 1 (also known as an ace) to 10, and the picture cards of Jack, Queen and King. The number or picture Jack, Queen or King is the value of the card so that each of the ordinary cards has a value and a suit.

References to tokens throughout the description are intended to include chips, tokens, casino dollars, cash or other objects which represent money and are capable of being used in gambling games.

With reference to the embodiments of the invention as described in the summary of the invention, the selectable regions of wheel are associated to indicia that directly correspond to or can be associated in the minds of players various playing cards. Preferably each indicia associated with each region on the wheel corresponds to a different playing card and thus is different to the other indicia.

The association can be achieved by including a pictorial representation of the playing cards on the wheel in or near the region. The representation may be a complete representation including colour and image that appears on a playing card. However it is thought that including the full image from the cards in a small region may be difficult to read, understand and may be distracting. As such it is preferred to include a partial representation of that appearing on the cards. Possible representations could include a number together with a suit indicator such as 1♣ for the Ace of clubs, and 10♠ for the 10 of spades. The picture cards could be represented by an image of the head ordinarily appearing on the card, such Jack, Queen or King together with the suit indicator. Alternatively the picture cards could be indicated by a letter J, Q or K for the Jack, Queen or King respectively, together with a suit indicator. The Joker cards could be indicated by a J and JJ for the first and second Joker cards, or an image of part of the Joker card. The Joker cards do not have a suit indicator.

The indicia could also include a coloured background, behind the representations of the playing card or near the representation. The coloured background would preferably be red, black or green in accordance with the traditional roulette style. The inclusion of a background colour is not required for the ordinary cards as the suit of the card could provide the red or black colour. However, it is preferred to include a coloured background, preferably the same as the colour of suit of the corresponding ordinary playing card. Such an arrangement should provide for ease of colour recognition and would result in the game looking similar to a traditional roulette game. For playing/wagering reasons there should be an equal number of red and black backgrounds on the wheel.

The Joker or Jokers indicia should have a different coloured background to that of the other (non joker) indicia. This colour difference will provide an operator (also referred to as the house) a winning margin when players wager on the colour outcome of a spin of the wheel. Furthermore it will help to distinguish Joker indicia from Jack indicia.

It is envisaged that the wheel would have 54 regions corresponding to the 54 playing cards. However, less regions and corresponding less indicia may also be used on the wheel. Such variations would include a 53 region arrangement, having indicia for the 52 ordinary playing cards and one of the joker cards. Another variation is a short deck arrangement wherein some of the 52 ordinary cards are omitted. By way of example a 42 region wheel could be used with 40 indicia corresponding to selected playing cards (such as 1 to 10 or 4 to King of each suit) and 2 indicia corresponding to the jokers.

Another variation uses a wheel having 48 regions corresponding to the playing cards 2 to King of the four suits. The wheel would contain one or more additional regions corresponding to Joker or Ace indicia where the Ace is unsuited, and has or is associated with a different colour to that of the 48 regions, such as a green background. In this variation an Ace would function like a Joker.

Another variation of the game includes one or two Ace indicia, neither having suit which could be separately indicated by A and AA on a green background instead of the Joker indicia. Alternatively the game may include a Joker and a non-suited Ace indicia.

Preferably the indicia selecting means operates in the same manner as a roulette wheel. The means for randomly selecting a region of the wheel may be a ball that is locatable within the selectable regions of the wheel. A region could be selected by rotating the wheel and releasing the ball onto the wheel. The ball would rotate around the wheel near or at the perimeter of the rotating wheel. The perimeter should be inclined to direct the ball into the selectable region of the wheel. When the rate of rotation of the wheel gravity will overcome the centripetal force keeping the ball near the perimeter and the ball will travel down the inclined surface into the selectable regions. The selectable regions may be adapted to offer some resistance to the further movement of the ball by including low barriers around the regions. Eventually the ball would be captured within a region, thereby selecting that region and the indicia associated thereto.

Preferably the wheel would rotate about a vertical or near vertical axis like a roulette wheel.

Preferably the wagering area includes indicia which can be associated to the indicia included on the rotatable wheel. Preferably the wagering area includes defined regions for positioning wagers as to the outcome of each operation of the wheel. Preferably the wagering area is arranged in a manner similar to that of a roulette wagering area as such an arrangement permits a number of different types of wagers.

The wagering area should provide for a number of different types of wagers, having different win and lose conditions and odds. The included wagers are preferably similar to that used in roulette in order to facilitate the playing of the game by players familiar with roulette.

The playable wagers would include a straight up bet (a bet made by placing a token completely within a defined region that solely corresponds to a single indicia such as the 10♠), split bets (a bet made by placing a token on any line that separates two adjacent regions), street bets (a single line of region), corner bets (a bet covering the junction of four adjacent regions), odds or evens bets and colour (red or black) bets could be included. Wagers could also be included for options not present in roulette such as the value of the selected indicia (1, 2, 3, Jack, Queen etc), the suit of the selected indicia (hearts, clubs, spades or diamonds), whether it is a picture card, and other wagers related to the selected playing card indicia.

A preferred wagering arrangement presents the indicia corresponding to that appearing on a 49 or 50 region wheel, by providing an "inside" wagering area including a primary array depicting the value of the card (2 to 10, Jack, Queen and King) set out in a 3 by 4, or a 2 by 6 arrangement. Around each of the value indicators there is provided a secondary 2 by 2 array depicting the four possible suits of each of the ordinary playing cards. This provides a convenient means for rapidly and clearly conveying the straight up bets (a wager on the selection of an individual indicia) whilst permitting split bets, corner bets, and value bet.

The non-suited Jokers or Aces could be separate from the primary array or positioned at one end of the array, within the inside wager area.

Such a game may provide advantages when used in a casino environment. It is believed that a game based around a 49 or 50 region wheel having 1 or 2 unsuited regions and a 2×6 wagering area will provide a game having a sufficient likelihood of providing a return to the player so to keep the interest of the player, whilst keeping the game sufficiently profitable for casino use.

Another preferred wagering arrangement presents the indicia corresponding to that appearing on a 53 or 54 region wheel, by providing an inside wagering area including a primary value array depicting the 12 of the 13 values of the cards set out in a 3 by 4, or a 2 by 6 arrangement. The $13^{th}$ value may be located at one end of the array or may be separate to the array. Alternatively, the primary value array may be set out in a 3 by 5 arrangement, with two void or blank regions at one end, on either side of a value region. Around each of the values is located a 2 by 2 secondary array depicting the suits of the cards. A joker (or two joker boxes if there is a 54 region wheel) may also be located at the end of the value array or separate to the array, as part of the inside wagering area.

The wagering area may include a system wagering area also known as an "outside" wagering area. This area may be located near to the inside wagering area for making of bets not encompassed by the inside wagering area. The system wagers could include bets as to the colour, suit, type of value (evens covering 2, 4, 6, 8, 10 and queen or odds covering 1,3, 5, 7, 9, Jack and King) or a range of values (2 to 7 or 8 to King) of the selected indicia.

Different types of wagers may be made by positioning a token or cash on the wagering area in a recognised manner. It is preferred to use tokens as different looking tokens may be used to distinguish between the wagers of one player from another.

The odds of winning a particular wager will depend on the number of occurrences of indicia that would meet the win conditions on the wheel for the wager and the total number of indicia included on the wheel. The return to the player will depend on these factors and when used in a casino or other gambling house, should be less than the odds of winning in order to provide the house with a margin on the game. The rules may provide for limitations on the payments possible for certain wagers. Alternatively, the game may be used as a toy, and in such conditions the wagering aspect may be removed or modified.

The game may be played on a custom table having designated areas for the placement wagers, and for locating the indicia selecting means. The table could also provide for placement positions for locating the operator and the players. The operator is normally located on one side of the table with the players being located on one or more sides, different to the operator's side. Such a table would be of use in a casino environment when it is important for security reasons to prevent the players from having access to the cash or tokens or operator.

In a further embodiment of the game there is provided an electronic form of the game, wherein part or all of the game processes is operated by or replaced with a computer or poker machine apparatus. Players may provide wagers via an input device, which is processed by a computer, which then proceeds to provide the operation, outcome and result phases. In such a system the indicia selecting means may be replaced with an electronic simulation of a rotating wheel and means for selecting a region.

In a preferred form the game would be entirely played on a computer by using a "slot" machine or the like, or via a network such as the internet in an online casino environment.

In a further embodiment the game also includes a jackpot game. The jackpot game is a separate game played within the main game. A player will also be eligible to win a jackpot bonus if they elected to play the jackpot game by placing a side bet, typically for a fixed amount such as one token. The token may be payable with each operation of the main game, or may provide for eligibility for a number of games of the main game.

It is preferred that the player would have to pay the token with each operation of the main game in order to retain eligibility in the jackpot game. This may entice a player to continue to play additional games of the main game if it appears that they may win a jackpot. It would also avoid the difficulties of locating a player who wins a jackpot after leaving the gaming area if they were to retain eligibility for the jackpot game.

In one form a player would win the jackpot game if they satisfied the conditions of being an eligible player and if a number of consecutive outcomes of the main game resulted in a predetermined combination of indicia. The required arrangement indicia may be a traditionally high ranking (low likelihood of occurrence) poker hand such as a royal flush or four of a kind. The number of consecutive outcomes would depend on the required combination of indicia to trigger the jackpot win, and may be four or five for a poker hand combination. The amount won may vary depending on combination of indicia. There may be multiple combinations of indicia that will satisfy a win condition. Different combinations may provide a different jackpot prize. If two or more eligible players win the jackpot, they could share the jackpot.

When a jackpot side game was included with the main game it is preferred to include a means for recording the required number of consecutive outcomes of the main game, and the eligibility of the players. In a preferred form the gaming apparatus would include a main game outcome display means for displaying at least the last four consecutive outcomes of the main game and player eligibility display means. The player eligibility display means may be one or more light indicators such as a LED's that are lit when a player deposits a token in a jackpot token receiving apparatus. The display may include intermediate indicators to indicate the status of the player including the number of consecutive jackpot wagers. When a sufficient number of consecutive wagers have been placed an eligible player indicator could light up to indicate the eligibility of the player. The sufficient number of consecutive wagers is typically equal to the minimum number of consecutive main games required to provide a combination capable of winning a jackpot. The eligible player status could be indicated by having all of the intermediate indicators lit or a separate indicator.

A computer would preferably monitor the main game outcomes and the player eligibility and would determine whenever an eligible player wins the jackpot.

The jackpot device could also be incorporated into a traditional roulette game. The jackpot winning combination in a roulette game would be one or more predetermined sequences of numbers.

One form of the game system will now be described with reference to FIGS. 1, 2 and 3.

Figure 2:
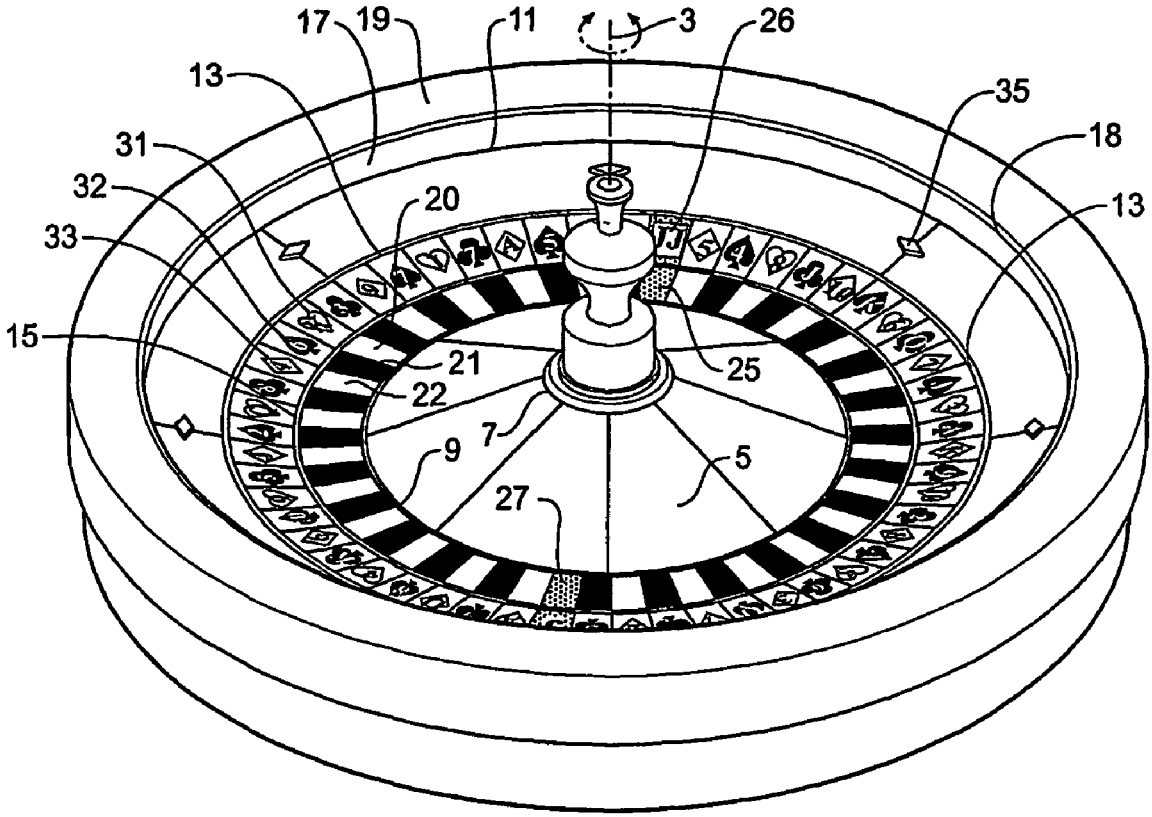
FIG. 2 depicts a perspective view of the wheel shown in FIG. 1.

FIGS. 1 and 2 depict a wheel for use with a game of the present application. The wheel (1) rotates about a central substantially vertical axis (3). The section (5) of the wheel near the central axis between the perimeters (7) and (9) provides an inner inclined surface with the upper part corresponding to the perimeter (7) and a lower part corresponding to the perimeter (9).

The section of the wheel located between the perimeters (9) and (15) is substantially horizontal.

The section of the wheel located between the perimeters (15) and (11) provides an outer inclined surface having a lower part at perimeter (9) and an upper part at the perimeter (11).

The section of the wheel located between the perimeters (9) and (15) has been divided into 54 separate regions, each region having a different colour indicia to the adjacent regions. An example of three of the regions are (20), (21), and (22). Regions (20) and (22) are red in colour and region (21) is black.

The section located between the perimeters (13) and (15) has been divided into 54 parts each having different indicia that can be associated with playing cards. Each region in the section between (9) and (15) is associated by proximity with indicia located between (15) and (13). By way of example, region (20) is associated with the indicia (31), namely the king of hearts (31), region (21) is associated with the six of spades indicia (32) and a region (22) is associated with the four of diamonds indicia (33). The indicia may be randomly arranged within the section. The arrangement may be wholly random or it may alternate between a randomly selected black suited card and a randomly selected red suited card. The arrangement depicted is based on the later arrangement, with the Joker and Double Joker indicia being placed at opposite sides of the axis (3).

The regions and indicia are associated with three different colours namely black, red and green. The indicia having a black suit being spades or clubs are associated with a black region. The indicia associated with a red suit are shown in red and are associated with a red region. The joker playing cards are represented by the indicia (26) and (28) and appear on a green background. These indicia are associated with corresponding regions (25) and (27) respectively. The indicia comprising of a 'J' on a green background (28) represents the joker, whilst the indicia 'JJ' on a green background (26) which represents the other joker, referred to as the double joker.

The outer section (19) of the wheel provides a surface for an operator to contact and turn and spin the wheel.

At perimeter (11) there is a barrier (17) that acts to prevent a ball from leaving the wheel when the wheel and ball are in motion. This barrier may take the form of a vertical or near vertical wall. The inner part (18) of the outer section (19) forms an inner lip and extends over a part of the section between (11) and (13). The lip and wall also acts as a barrier to prevent the ball from leaving the wheel during use.

In operation the wheel is rotated about the central axis (3) by the application of force to the outer section (19). A ball is released onto a rotating wheel between the perimeter (7) and the wall (17). After the ball is released the wheel is not normally further rotated and instead is permitted to slow down and stop.

In one method the ball is dropped onto or near the inclined surface (5). The ball passes down the inner inclined surface and travels up the outer inclined surface towards the perimeter of the wheel. The ball is constrained by the wall (17) and thus travels around the outer inclined surface between (11) and (13).

In another method the ball pressed against the wall (17) by an operator and released. Again the ball is constrained by the wall (17) and thus travels around the outer inclined surface between (11) and (13).

As the rate of rotation of the wheel decreases the ball will leave the surface of the wall (17) and will travel down the outer inclined surface towards the lower part of the outer inclined surface. As the ball travels inwards it will contact the protrusions (35). These protrusions act to randomise the motion of the ball and further slow the ball. Eventually, the rotation of the wheel slows such that the ball travels down the outer inclined surface to the region between (15) and (9). Eventually, the ball will come to rest in one of the 54 regions located in this section.

To ensure that the ball comes to rest clearly within a single region there are protrusions extended upwards between the border between adjacent regions. The protrusions acts as low wall to assist in separating each region and preventing the ball from coming to rest between two regions.

Figure 3:
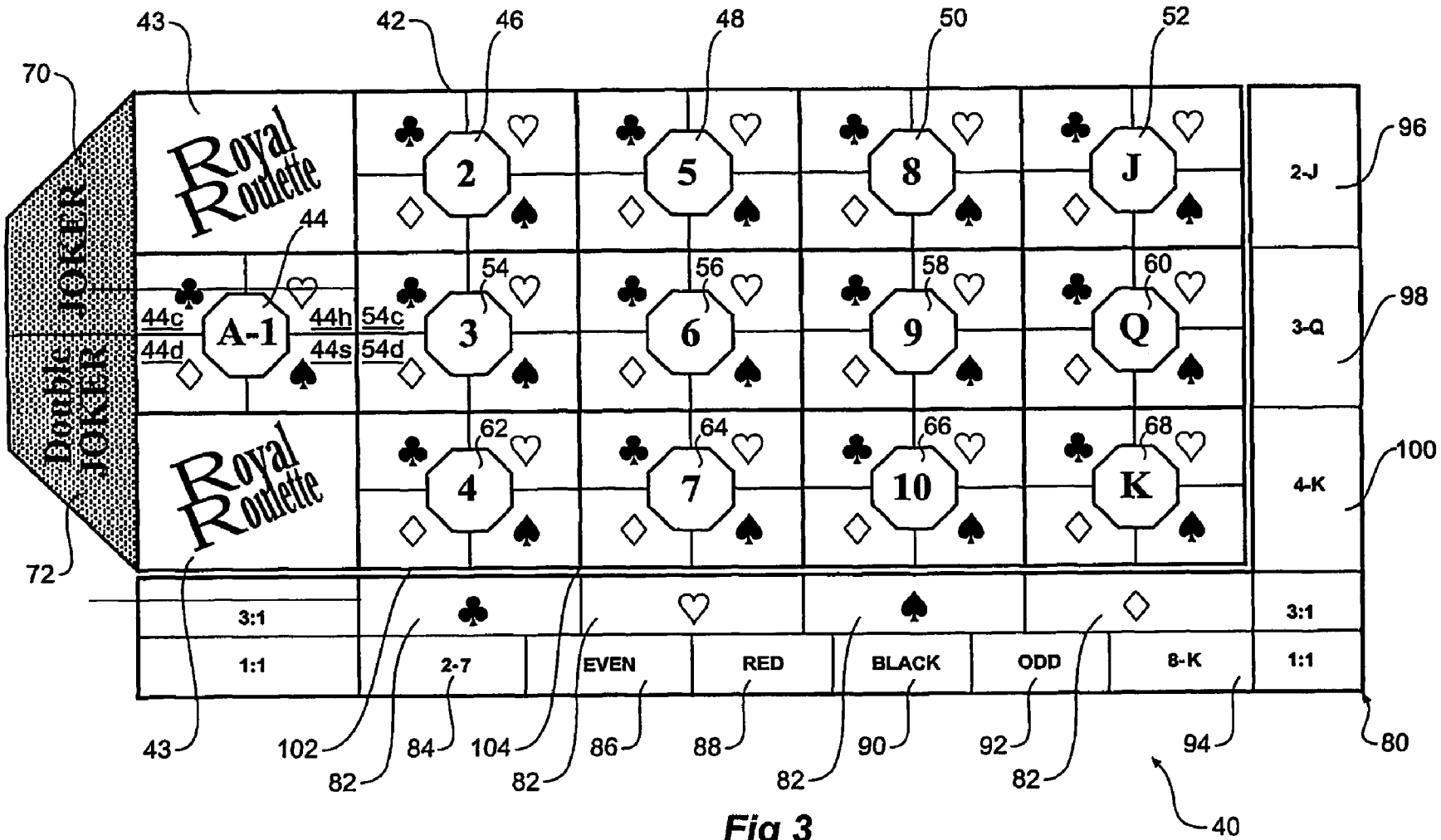
FIG. 3 depicts a plan view of a wagering layout for use in the game of the present invention.

FIG. 3 depicts a wagering area (40) for use with a selecting apparatus such as that depicted in FIG. 1 for gambling. The wagering area has an inside wagering area (42) having therein a 5 by 3 primary array providing 15 zones or boxes. There are 13 zones (44) to (68) which include indicia corresponding to the 13 values of ordinary playing cards. The array includes two unused zones (43) that may be void for the placing of wagers. These zones may include advertising or promotional information.

Around each of the 13 value indicia in the primary array there is a secondary 2×2 suit array depicting the four suits indicia. By example the ace value (44) has a black club (44*c*) a red heart (44*h*) a red diamond (44*d*) and a black spade (44*s*) located around the central value (44). The ace value (44) is shown with both an A and a 1 symbol therein. This is done to indicate that the Ace is treated as the number 1.

The inner wagering area also includes a portion for placing wagers on the Joker (70) and Double Joker (72).

The wagering area also includes an outer wagering area (80) located near the value array. This outer area permits wagers to be made in respect of the suit of the cards by placing tokens over the appropriate indicia (82). It also includes regions for placing wagers as to whether the selected indicia is a number between 2 and 7 (84) is an even number (86), is red in colour (88) (i.e. the heart or diamond suit), is black in colour (90) (i.e. the spade or club suit), is an odd number (92), or has a value between 8 and King (94): The outer area also provides for making wagers regarding whether the selected indicia has a value of 2, 5, 8 or Jack (96), has a value 3, 6, 9 or Queen (98) or has a value of 4, 7, 10 or King (100).

In use a player can place a wide range of wagers on the wagering area. A straight up bet (one number) may be made by placing a token on the suit symbol corresponding to the value of the card in the inner wager area. For example, if it were desired to place a wager on the ace of clubs a token would be placed wholly within the (44*c*) box. Placing a token within the Joker box (70) makes wager that will win if a Joker is selected by the selecting apparatus.

Placing a token on any line that separates two adjacent symbols within the inner wager area (42) may make a split wager. For example, if it were desired to place a split wager on the ace of hearts and ace of spades a token would be placed on the line separating boxes (44*h*) and (44*s*). A split wager could also be made by placing a token on the line separating the Joker and Double Joker boxes (70) and (72) which would result on a win if either Joker was selected by the selecting apparatus.

A corner wager can be made by placing a token at the junction of four adjacent symbols within the inner wager area (42). For example if a token were placed at the junction of (44*h*), (44*s*), (54*c*) and (54*d*) the player would win if the ace of hearts, ace of spades, three of clubs or three of diamonds were selected by the selecting apparatus.

A modified form of the corner wager is the value wager. If a player were to place the token solely on the value symbol then this covers the value of the card irrespective of the suit. For example, if a token were placed on A-1 the player would win if the ace of any suit was selected by the selecting apparatus.

Another wager is the street wager. The making of this wager is indicated by placing a token across only the line that separates the inside and outside wagering area. For example, if a player were to place a token at the point (102) the player would be making a street wager. A player would win if the two of clubs, two of diamonds, three of clubs, three of diamonds, four of clubs or four of diamonds were selected by the selecting apparatus.

Another wagering option is a line wager. A player can make a line wager by placing the token across the line that separates the inside and outside wagering area and across the line that separates two adjacent suits within the inner betting area. For example, if the player were to place a token at the point (104) the player would be making a line wager and would win if the selecting apparatus selected a two, three or four of hearts or spades or a five, six, seven of clubs or diamonds.

In all cases the return to the player would depend on the likelihood of the player winning the wager. If a player were to make a straight up bet (which includes a joker or double joker bet) then one token would normally provide a 51 token return if the selecting apparatus of FIGS. 1 and 2 were used. The likelihood of such an event occurring is a 1 in 54. At the other extreme if the player were to make a red or black bet then a one token bet would ordinarily pay one token and the player has a 26 in 54 (48%) chance of this occurring.

The selecting apparatus of FIGS. 1 and 2 and the wagering area of FIG. 3 may be conveniently locate together in a table for use in casinos or gambling houses. Alternatively an electronic representation of the selecting apparatus of FIGS. 1 and 2 and/or wagering area of FIG. 3 may be provided.

Figure 4:
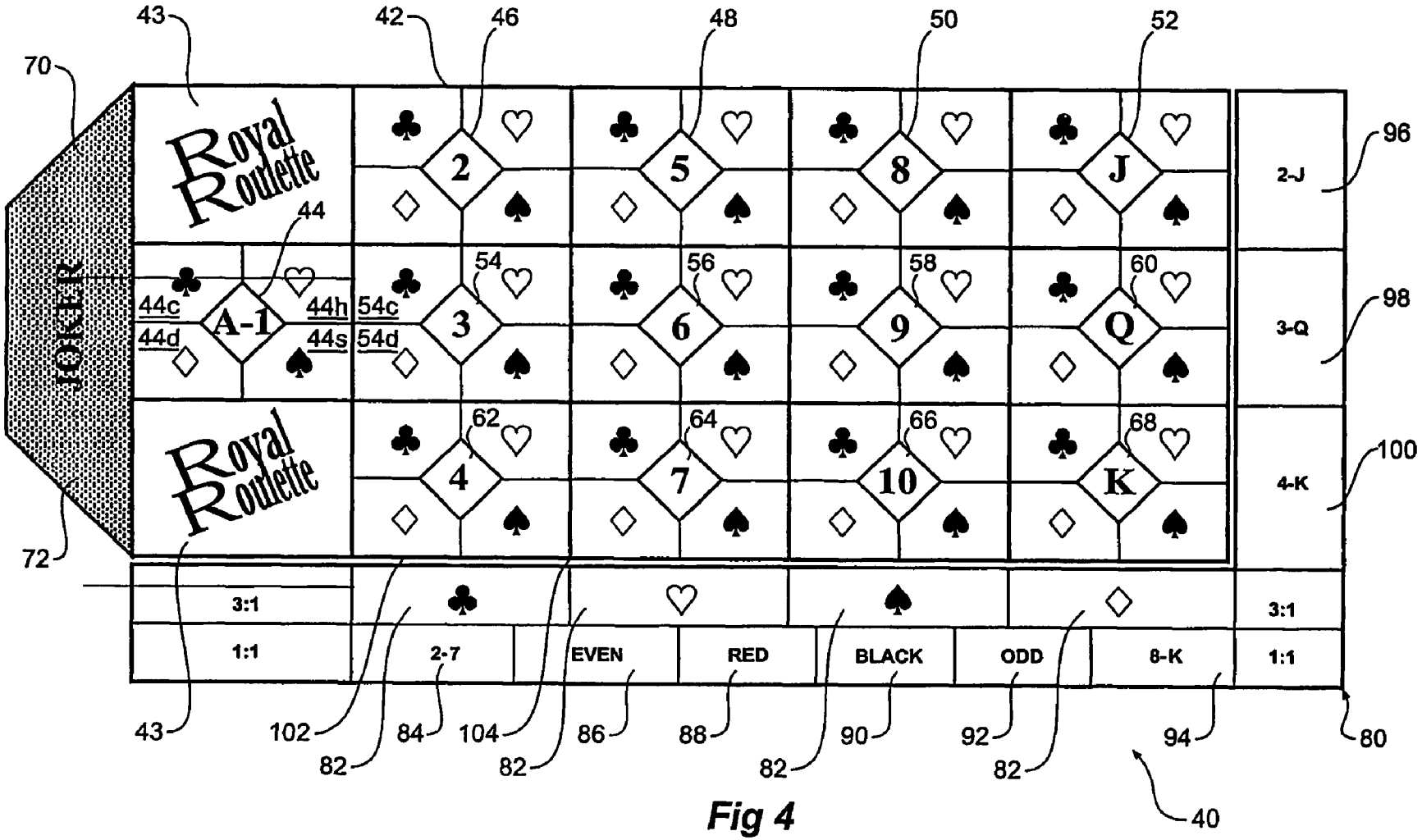
FIGS. 4 and 5 depict variations on the wagering layout of FIG. 3.
Figure 5:
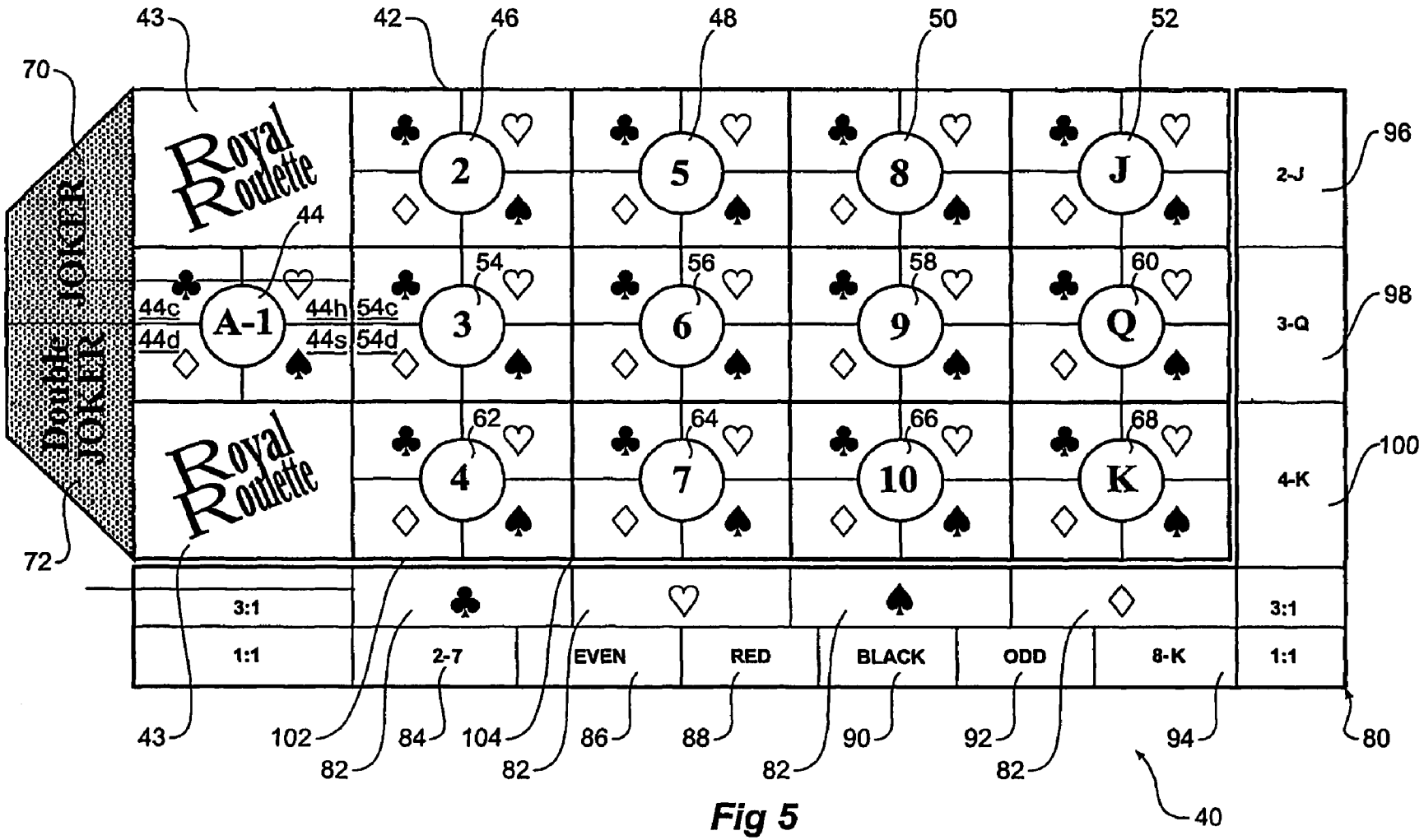

FIGS. 4 and 5 depict variations in the design of the layout of FIG. 3. FIG. 4 requires a 53 region wheel with only one Joker, or a 54 region wheel having two identical Jokers thereon.

Figure 6:
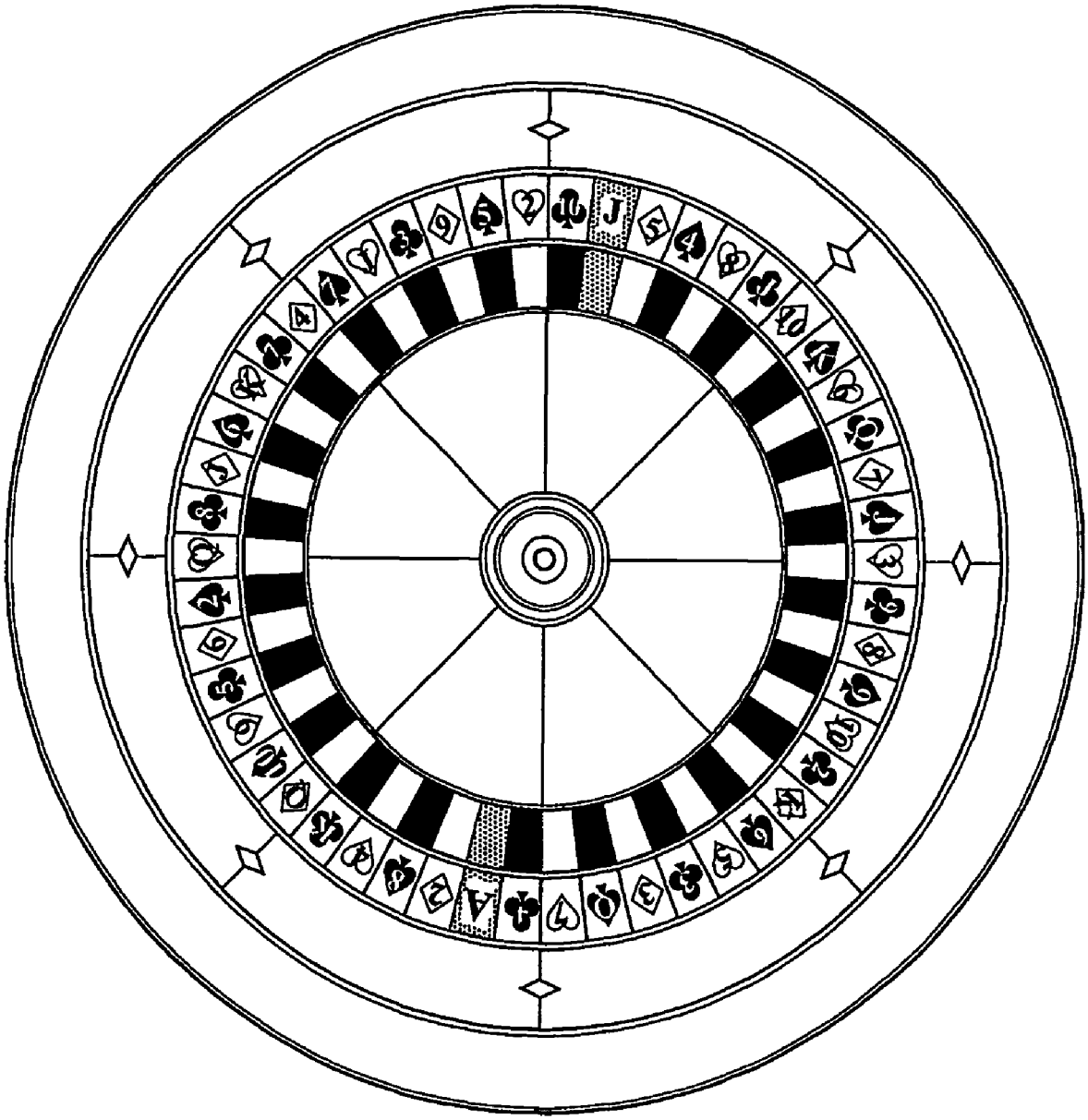
FIG. 6 depicts a plan view of an alternative wheel for use with the present invention.
Figure 8:
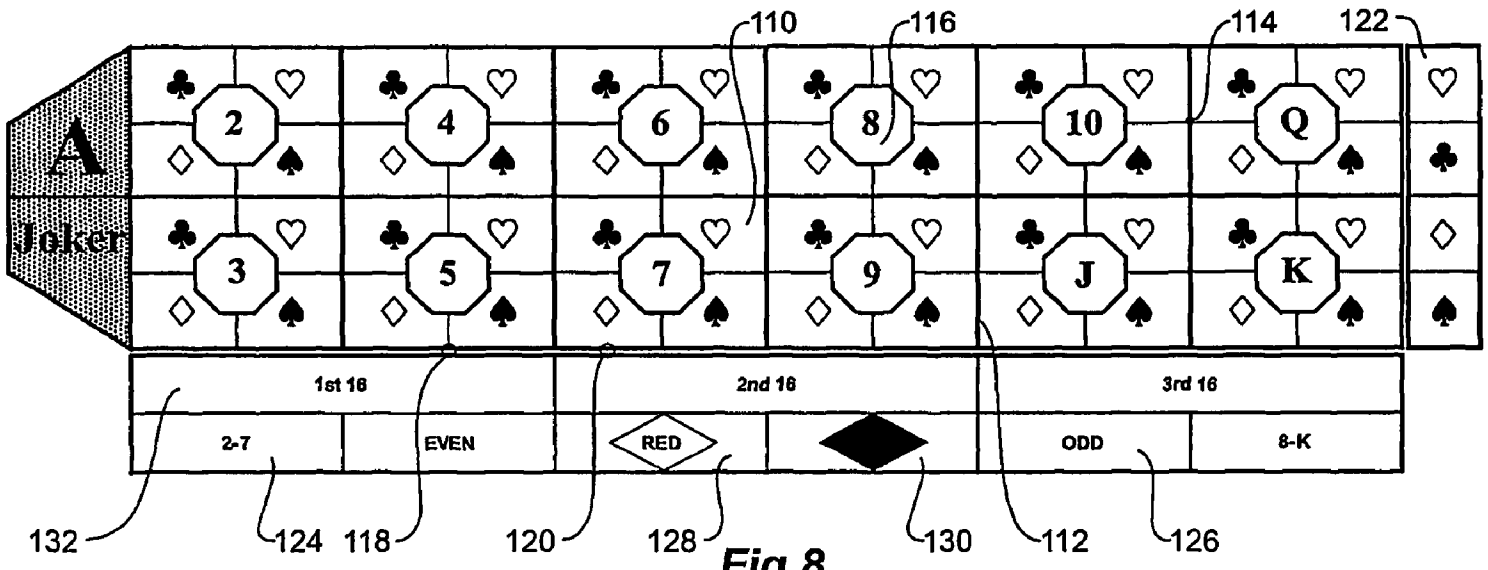
FIG. 8 depicts a variation of the wagering of FIG. 7.

FIG. 6 depicts a 50 region wheel, for use with the wagering area of FIG. 8. It has one unsuited Ace and one Joker. There are no suited Aces on the wheel.

Figure 7:
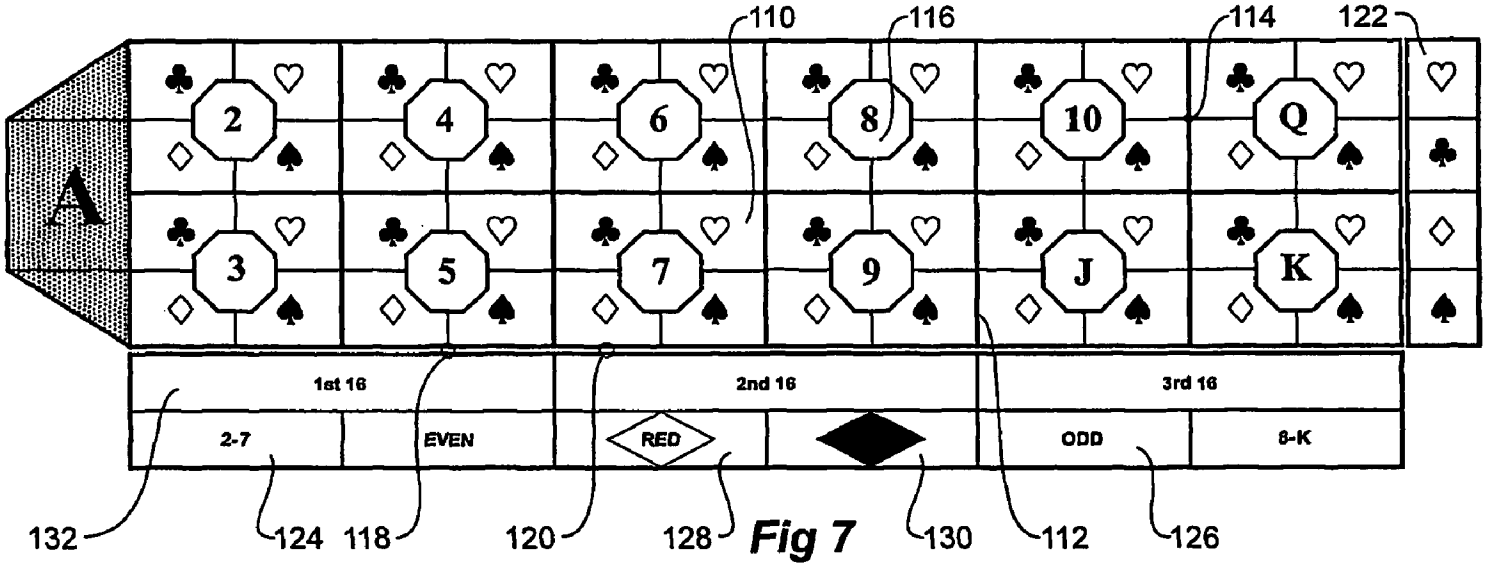
FIG. 7 depicts a plan view of a wagering layout for use with the wheel of FIG. 6.

FIG. 7 is an alternative layout of the wagering area and would require the Joker of the wheel of FIG. 6 to be replaced with an unsuited Ace, or a 49 region wheel.

Figure 9:
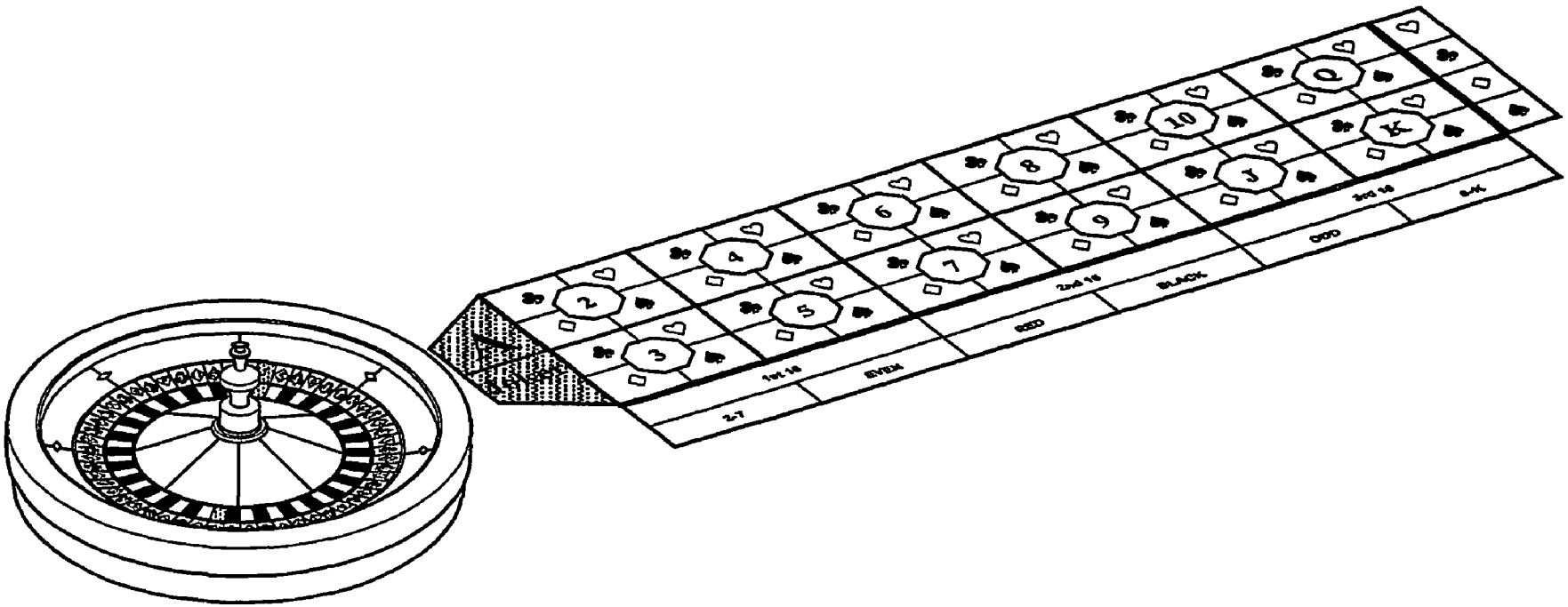
FIG. 9 depicts a perspective wheel and wagering layout combination.

FIG. 8 is a preferred layout of the wagering area and is also shown in FIG. 9 in conjunction with the wheel depicted in FIG. 6. The layout of the wagering area should be commercially acceptable to a casino based on the analysis set out hereafter.

The wagering area depicted in FIGS. 7 and 8 allow for the making of wagers by placement of tokens on the wagering area in the manner earlier described for the wagering area of FIG. 3.

For example a straight up wager that the next selected region would be associated with the 7 of hearts would be indicated by placing a token in box (110). A split wager that the next selected region would be associated with the 9 of spades or Jack of diamonds could be made by placing the token at the point (112).

A corner wager that the next selected region is associated with 10 of hearts or spades, or Queen of clubs or diamonds by placing a token at the point (114).

A modified corner wager that the next selection was 8 of any suit by placing the token within the box (116).

Line and street wagers can also be made, although less regions are covered by the wager as compared to the line and street wagers described in FIG. 3. For example a token placed at point (118) would indicate a street wager that the selected region will be associated with a 4 or 5 of any suit (8 regions in total). A token placed at point (120) indicates a line wager covering the 6 and 7 of clubs and diamonds.

Similar to that depicted in FIG. 3, the outer wagering area of FIGS. 7 and 8 includes boxes for making other types of wagers.

For example, the player could make a bet that the suit of the indicia associated with the selected region will be a heart by placing a token in the box (122). A token placed in box (124) would indicate a wager that the next selection will have a number from 2 to 7. A token in box (126) will indicate a wager that the selection will be an odd number (for game balance odds exclude the "Ace"). Wagers as to the colour of the indicia associated with the selected region can be made by placing a token in the boxes (128) for red and (130) for black Finally, a token in boxes (132) indicates a wager as to whether the selection is any of the 16 indicia directly above in the inner wager area, namely any 2, 3, 4 or 5 of hearts, clubs, spades or diamonds.

Wagers on odd numbers on the layout of FIG. 7 or 8 do not include the unsuited Ace.

The following analyses the house profit that would arise from the use of various versions of the game in a casino environment.

The analysis is based on the belief that certain properties are highly desired or required in order to use the game at a casino. However, these properties may be less or not relevant in respect the operation of the game for pleasure in a non-commercial enterprise.

(1) The principal requirement is that the house profit should be between 1% and 6% of the bets made, and preferably between 2% and 5%. Otherwise the game may be unsatisfactory either to the casino or to the players. Standard roulette yields a casino profit of 2.7% with a single zero, and 5.3% with a double zero.

Other properties also considered desirable include:

(2) The odds should be whole numbers as far as possible, to simplify the task of paying winners. Complex fractional odds would be unpopular with croupiers, or perhaps impossible to handle.

(3) It is also desirable that the various types of bet should be consistent in their outcomes, as in roulette. For example, betting $100 on a split should have the same outcomes as betting $50 on two squares. This property is equivalent to saying that the house profit on each type of bet is the same. This property is not universal in table games. For example craps does not have it.

The profitability for the house of each type of bet depends on:

The number of individual outcomes covered by the bet

The odds paid for a win

The total number of outcomes (determined by the number of jokers).

There are various ways of measuring profit in a casino. They include the average amount lost by a player before they leave the casino, the average amount lost per player while at a table, the profit made per hour at a table. These can be expressed in absolute dollar terms or as a percentage of the chips purchased. Some of these measures depend on human behavior such as the period spent at a table, and can be discovered only by experience. Where skill is involved as in blackjack, it depends on the skill of the players. The number of players at the table comes into some measures.

For simplicity, the profit figure used in these reports is the average percentage of each bet lost by a player. This is easily calculated for a game like roulette. If a player's chips are recycled many times during a playing session, the amount lost is correspondingly increased.

Table 1 below shows the profitability of each type of bet for the game variants which correspond to the 52 cards in a deck of standard playing cards, together with one or two jokers. As a consequence the wheel contains 53 or 54 slots. The odds on the wagers were selected to generate profit within the acceptable range as described above.

TABLE 1

| | Odds | Group Size | Profit 2 jokers | Profit 1 joker |
|---|---|---|---|---|
| Straight Up | 51 | 1 | 3.70% | 1.89% |
| Straight Up | 50 | 1 | 5.56% | 3.77% |
| Straight Up | 49 | 1 | 7.41% | 5.66% |
| Split | 25 | 2 | 3.70% | 1.89% |
| Split | 49 to 2 | 2 | 5.56% | 3.77% |
| Split | 24 | 2 | 7.41% | 5.66% |
| Group of 3 | 49 to 3 | 3 | 3.70% | 1.89% |
| Group of 3 | 16 | 3 | 5.56% | 3.77% |
| Group of 3 | 47 to 3 | 3 | 7.41% | 5.66% |
| Group of 3 | 15 | 3 | 11.11% | 9.43% |
| Corner | 12 | 4 | 3.70% | 1.89% |
| Corner | 47 to 4 | 4 | 5.56% | 3.77% |
| Corner | 23 to 2 | 4 | 7.41% | 5.66% |
| Corner | 11 | 4 | 11.11% | 9.43% |
| Six Line | 23 to 3 | 6 | 3.70% | 1.89% |
| Six Line | 15 to 2 | 6 | 5.56% | 3.77% |
| Six Line | 22 to 3 | 6 | 7.41% | 5.66% |
| Six Line | 7 | 6 | 11.11% | 9.43% |
| Dozen | 10 to 3 | 12 | 3.70% | 1.89% |
| Dozen | 13 to 4 | 12 | 5.56% | 3.77% |
| Dozen | 19 to 6 | 12 | 7.41% | 5.66% |
| Dozen | 3 | 12 | 11.11% | 9.43% |
| Suit | 3 | 13 | 3.70% | 1.89% |
| Suit | 38 to 13 | 13 | 5.56% | 3.77% |
| Suit | 37 to 13 | 13 | 7.41% | 5.66% |
| Column | 9 to 4 | 16 | 3.70% | 1.89% |
| Column | 35 to 16 | 16 | 5.56% | 3.77% |
| Column | 17 to 8 | 16 | 7.41% | 5.66% |
| Red/Black | 1 | 26 | 3.70% | 1.89% |
| Red/Black | Even-4% | 26 | 5.56% | 3.77% |

A particular version of the game can be obtained by selecting either one or two jokers, selecting which bets are to be made available, and specifying what odds are to be paid for winning bets. For these variations it is not easy to choose a combination which simultaneously meets the desirable criteria of appropriate casino profit, simplicity and consistency.

One selection from the table above gives the version of the game as set out in table 2 below.

TABLE 2

| | Odds | Group Size | Profit 2 jokers | Profit 1 joker |
|---|---|---|---|---|
| Straight Up | 50 | 1 | 5.56% | 3.77% |
| Split | 24 | 2 | 7.41% | 5.66% |
| Group of 3 | 15 | 3 | 11.11% | 9.43% |
| Corner | 11 | 4 | 11.11% | 9.43% |
| Six Line | 7 | 6 | 11.11% | 9.43% |
| Dozen | 3 | 12 | 11.11% | 9.43% |

Unfortunately, the odds here are not consistent, in that a player can always get better value by betting straight up than by betting on groups.

Different choices could be made which overcome these problems, but at the expense of introducing more complex odds. Table 3 provides an example of another variation of the game.

TABLE 3

| | Odds | Group Size | Profit 2 jokers |
|---|---|---|---|
| Straight Up | 51 | 1 | 3.70% |
| Split | 25 | 2 | 3.70% |
| Group of 3 | 49 to 3 | 3 | 3.70% |
| Corner | 12 | 4 | 3.70% |
| Six Line | 23 to 3 | 6 | 3.70% |
| Dozen | 10 to 3 | 12 | 3.70% |
| Suit | 3 | 13 | 3.70% |
| Column | 9 to 4 | 16 | 3.70% |
| Red/Black | 1 | 26 | 3.70% |

In this case the odds are all consistent and the profit is very satisfactory, since its value lies between the values for standard roulette with single or double zeros. These choices could provide a satisfactory game, and one which could be further improved by eliminating the bets on groups of three and groups of 6, where the odds are complex.

Another variant of the proposed game has one slot on the wheel corresponding to each card in a standard deck, but with no jokers and only two aces or a joker and an ace or two jokers. The aces and/or jokers would play the role of the zero and double zero in a version of standard roulette.

Table 4 below shows the results of a version of this variation of the game.

TABLE 4

| | Odds | Group Size | Profit |
|---|---|---|---|
| Straight Up | 47 | 1 | 4.00% |
| Split | 23 | 2 | 4.00% |
| Group of 3 | 15 | 3 | 4.00% |
| Corner | 11 | 4 | 4.00% |
| Group of 6 | 7 | 6 | 4.00% |
| Group of eight | 5 | 8 | 4.00% |
| Dozen/Suits | 3 | 12 | 4.00% |
| Columns | 2 | 16 | 4.00% |
| Red/Black | 1 | 24 | 4.00% |

This version is preferred as it has a number of attractive features. A large number of different inside & outside bets can be made available, including a group of eight that does not occur in standard roulette. All of these bets are completely consistent. For example, the result of betting on a dozen is the same as betting on two groups of 6. All of the payouts are whole numbers, so there are no special problems for dealers.

The casino profit per bet is approximately 4% in every case. This should be satisfactory to casino and regulatory authorities. It also offers the player a better return than a standard roulette game with a double zero.

Other game variants are also possible. A variant involves an enlarged game having 60 cards plus two jokers. This could be done either by introducing two extra ranks, or one extra suit. Card decks already exist with an extra suit, which are called stars. Table 5 below sets out a version of such a variation.

TABLE 5

| | Odds | Group Size | Profit |
|---|---|---|---|
| Straight Up | 59 | 1 | 3.23% |
| Split | 29 | 2 | 3.23% |
| Group of three | 19 | 3 | 3.23% |
| Corner | 14 | 4 | 3.23% |
| Group of five | 11 | 5 | 3.23% |
| Six Line | 9 | 6 | 3.23% |
| Dozen | 4 | 12 | 3.23% |
| Columns | 3 | 15 | 3.23% |
| Twenties | 2 | 20 | 3.23% |
| Red/Black | 1 | 30 | 3.23% |

This game looks satisfactory based on the profit and odds offered.

Another variant of the game would have one slot on the wheel corresponding to each card in a standard deck, but with only one joker or one ace. The joker or ace would play the role of the zero in standard roulette. Table 6 below shows the results of various bets in this game.

TABLE 6

| | Odds | Group Size | Profit |
|---|---|---|---|
| Straight Up | 47 | 1 | 2.04% |
| Split | 23 | 2 | 2.04% |
| Group of 3 | 15 | 3 | 2.04% |
| Corner | 11 | 4 | 2.04% |
| Group of 6 | 7 | 6 | 2.04% |
| Eight | 5 | 8 | 2.04% |
| Dozen | 3 | 12 | 2.04% |
| Columns | 2 | 16 | 2.04% |
| Red/Black | 1 | 24 | 2.04% |

This version is similar to the version which had two aces (or a joker and an ace or two jokers) but provides a lower profit for the casino. The same variety of bets is available, and the bets are all consistent. The payouts are all whole numbers, as before.

The casino profit per bet is now 2.04%, which is roughly half the profit obtained with two aces. This would be great for the players, because their money would last much longer. However some casinos may not be interested in a game where the profit rate is less than for any current version of roulette (2.7% or more).

However, this variation may still be commercially acceptable to casinos:

- if it attracted a lot of activity because of its novelty
- in a high roller area where a lower percentage is acceptable as the size of the minimum wagers are higher
- in an online/electronic format, where overheads are lower.

It would be appreciated by a person skilled in the art the numerous variations and/or modifications may be made to the invention as shown the specific embodiments without departing from the spirit or scope of the invention as broadly described. For example the playing and indicia may be replaced with indicia related to other games such as mahjong, paigow or sic-bo. The present embodiments are, therefore, to be considered in all respects as illustrative and not restrictive.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The invention claimed is:

1. A method of effecting an economic outcome between one or more players and an operator in a roulette style game, which method includes using a roulette style game apparatus having an indicia selecting means including a rotatable wheel having 49 or 50 regions, each region associated with playing card indicia, and a means for randomly selecting a selectable region of the wheel; and a wagering area adapted for positioning wagers concerning the indicia associated to the region selected by a single operation of the rotatable wheel, the method including the steps of, a) a wagering phase wherein each player providing a cash or token wager on the wagering area, the location of wager corresponding to one of the 49 or 50 regions and defining the win or lose conditions of that wager;

b) an operation phase after the wagering phase wherein the rotatable wheel is rotated and a ball is located on a rotating wheel, in a manner capable of randomly selecting one of the 49 or 50 regions of the wheel;

c) an outcome phase wherein the ball becomes located on one of the 49 or 50 regions of the wheel and thereby selects that region and indicia associated thereto;

d) a result phase after the outcome phase for each single operation of the indicia selecting means, wherein an assessment of each wager of each player is effected by comparing the selected indicia of the wheel to the win or lose conditions of the players wager and effecting a payment of cash or tokens in response to a result of the comparison; and e) wherein the profit is consistent for all selectable regions.

2. The method according to claim 1 when performed using the game apparatus according to claim 1.

3. The method according to claim 2 when the results phase includes an assessment as to whether the win or lose conditions of a jackpot wager have been fulfilled and effecting a payment of cash or tokens in response to the assessment.

4. The method of claim 3 wherein the win or lose conditions of the jackpot wager depend on the outcome of up to five consecutive operations of the game apparatus.

5. The method of claim 4 wherein the win or lose conditions of the jackpot wager depend on whether the indicia selected by five consecutive operations of the game apparatus are equivalent to predetermined poker hands.

6. An electronic roulette style game for effecting an economic outcome between a player of the game and the provider of the game, the game including the steps of:

a) a wagering phase wherein the player makes a wager by selecting a location in a wagering area, the location of wager defining the win or lose conditions of that wager;

b) an operation phase after the wagering phase wherein the player is electronically displayed a rotating wheel having 49 or 50 selectable regions, each region associated with playing card indicia, and a ball located on a rotating wheel for identifying a randomly selecting region of the wheel;

c) an outcome phase wherein the ball is randomly located on one of the 49 or 50 regions of the wheel, to thereby display to the player the selected region and indicia associated thereto;

d) a result phase after the outcome phase for each single operation of the wheel wherein an assessment of each wager of the player is effected by comparing the selected indicia of the wheel to the win or lose conditions of the players wager and effecting a payment of cash or tokens in response to a result of the comparison; and e) a consistent profit for all selectable regions.

* * * * *